US010072381B2

(12) United States Patent
Fanta et al.

(10) Patent No.: US 10,072,381 B2
(45) Date of Patent: Sep. 11, 2018

(54) STARCH AMINE COMPLEXES FOR INCREASED WATER RESISTANCE OF PAPER

(71) Applicant: The United States of America, as Represented by the Secretary of Agriculture, Washington, DC (US)

(72) Inventors: George F. Fanta, Morton, IL (US); Frederick C. Felker, Morton, IL (US); Gordon W. Selling, Dunlap, IL (US)

(73) Assignee: The United States of America, as Represented by the Secretary of Agriculture, Washington, DC (US)

( * ) Notice: Subject to any disclaimer, the term of this patent is extended or adjusted under 35 U.S.C. 154(b) by 130 days.

(21) Appl. No.: 15/277,331

(22) Filed: Sep. 27, 2016

(65) Prior Publication Data

US 2018/0023252 A1 Jan. 25, 2018

Related U.S. Application Data

(60) Provisional application No. 62/363,962, filed on Jul. 19, 2016.

(51) Int. Cl.

| | |
|---|---|
| ***D21H 19/12*** | (2006.01) |
| ***D21H 21/16*** | (2006.01) |
| ***D21H 23/22*** | (2006.01) |

(52) U.S. Cl.
CPC ..... *D21H 19/12* (2013.01); *D21H 21/16* (2013.01); *D21H 23/22* (2013.01)

(58) Field of Classification Search
CPC ..... D21H 19/12; D21H 21/16; D21H 23/22
USPC ..... 428/537.5
See application file for complete search history.

(56) References Cited

U.S. PATENT DOCUMENTS

2012/0138249 A1* 6/2012 Sundholm ..... D21H 21/16 162/186
2014/0186644 A1* 7/2014 Dellinger ..... B32B 29/06 428/535

OTHER PUBLICATIONS

Yan Xiuhua. et al., Synthesis of fiber crosslinking cationic latex and its effect on surface properties of paper, Progress in Organic Coatings, (2013), 76:11-16.
Putseys, J.A. et al., Amylose-inclusion complexes: Formation, identity and physico-chemical properties, Journal of Cereal Science, (2010), 51:238-247.
Koskela, Juha P. et al., Long-Chain Fatty Ammonium Quaternaries in Papermaking, JAOCS, (2002), 79:921-930.
Fanta, G.F. et al., Preparation and Properties of amylose complexes prepared from hexadecylamine, Carbohydrate Polymers, (2013), 98:555-6561.
Emmambux, M.N., V-amylose Strructural Characteristics, Methods of Preparation, Significance, and Potiential Applications, Food Reviews International, (2012), 28:412-438.
Yoon, Y.S. et al., Starch-fatty complex modified filler for papermaking, Tappi Journal, (2006), 5(9):3-9.
Fanta, George et al., Poly(vinyl alcohol) composite films with high percent elongation prepared from amylose-fatty ammonium salt inclusion complexes; , Journal of Applied Polymer Science, (2016), 44110:1-8.

* cited by examiner

*Primary Examiner* — Leszek B Kiliman
(74) *Attorney, Agent, or Firm* — John Fado; G. Byron Stover

(57) ABSTRACT

Disclosed are methods of increasing the surface hydrophobicity of the surface of a cellulosic article involving applying a solution of amylose-fatty ammonium salt inclusion complex in water to the article and then optionally applying an alkaline solution to the article to neutralize said amylose fatty ammonium salt inclusion complex to form an insoluble amylose fatty amine inclusion complex. Also disclosed are cellulosic articles produced by the methods.

8 Claims, 1 Drawing Sheet

STARCH AMINE COMPLEXES FOR INCREASED WATER RESISTANCE OF PAPER

REFERENCE TO RELATED APPLICATION

This application claims the benefit of U.S. Provisional Application No. 62/363,962, filed 19 Jul. 2016, which is incorporated herein by reference in its entirety.

FIELD OF THE INVENTION

This invention relates to cellulosic articles made using a complex made from amylose corn starch and fatty ammonium salt (or after subsequent neutralization, a fatty amine) applied to a cellulosic substrate. This invention specifically relates to a method for producing a cellulosic article that is resistant to water penetration, as measured by measuring contact angle, by applying an amylose-fatty ammonium salt inclusion complex where the best properties are obtained after neutralization of the salt, providing the fatty amine, using dilute base.

BACKGROUND OF THE INVENTION

In a review manuscript by Samyn (Journal of Materials Science, 48: 6455-6498 (2013)), the means for imparting water resistance to cellulosics such as paper is detailed. Compounds such as abietic acid (from rosin), alkene ketene dimer, and alkenyl succinic anhydride are used. These reagents may impart high water resistance to paper with water contact angles up to 150°. In addition, in work disclosed by Sundholm and Alexander (U.S. Patent Application Publication 2012/0138249), the use of alkene ketene dimer and alkenyl succinic anhydride is also shown to provide increased hydrophobicity. Abietic acid may be a contact allergen, and requires the addition of aluminum salts to provide an insoluble material that will bind to the cellulose. This insolubility may lead to inhomogeneities in the final article. Alkene ketene dimer requires the use of some type of ketene in its synthesis; however, ketenes are hazardous chemicals which may require the use of hazardous acid chlorides in their synthesis. In addition, some amount of the ketene will react with water which will lead to non-effective ketones which will end up in the waste stream. Alkenyl succinic anhydrides, such as octenyl succinic anhydride, may cause severe skin/eye damage and may be an allergen. These anhydride reagents may also react with water and not bind to the cellulose. Both the ketene and anhydride methods require tight pH control during their application steps. These ketene and anhydride routes use either costly ingredients, are themselves hazardous chemicals, or they are synthesized from hazardous chemicals.

Yoon and Deng (Tappi Journal, 5: 3-9 (2006)) showed that starch-fatty acid complexes imparted increased hydrophobicity to paper. However, these complexes had limited solubility (must be kept above 70° C.) which made it necessary to incorporate clay into the paper formulation. The low solubility may cause complications in an industrial process.

Dellinger et al. (U.S. Patent Application Publication 2014/0186644) disclosed the production of water resistant paper through the use of an amide wax combined with a cellulose ester, shellac, and rosin. In addition, phospholipids or medium-chain length triglycerides were used to give increased performance. These compounds require the use of flammable solvents (such as propyl acetate or acetone) for them to be coated onto paper. When these solvents evaporate they may be considered as volatile organic compounds and must be controlled.

Hormi et al. (Journal of the American Oil Chemists Society, 79: 921-930 (2002)) detailed the use of long-chain fatty amine quaternary salt derivatives in modifying the surface properties of paper. These ammonium salts were produced from the corresponding fatty acids after reaction with glycidyl trimethylammonium chloride or by the reaction of a long chain amines with epichlorohydrin or epibromohydrin. These reagents are hazardous materials that require sophisticated equipment to handle them safely.

Geissler et al. (Cellulose, 21: 357-366 (2014)) utilized cellulose stearoyl ester nanoparticles to impart improved water resistance to paper. Water contact angles of up to 154° were obtained. The nanoparticles were produced using stearoyl acid chloride (~15:1 versus cellulose), pyridine (~25:1 versus cellulose), methylene chloride, acetone, and cellulose. The numerous hazardous reagents and the large amount of hazardous waste negate the benefits resulting from biodegradability.

As detailed in a review manuscript by Thuo et al. (Coatings, 5: 1002-1018 (2015)), silanes are a common class of compounds which can be used to treat cellulosic surfaces, such as paper or cotton, in order to improve their water resistance. The silane compounds of interest utilize a silyl-chloride bond as the active site for bonding to the cellulosic surface. Chlorosilanes are very hazardous chemicals that require significant investment to handle safely. Often the silane compounds will have fluorinated groups bound to them to impart additional hydrophobicity to the coating. These fluorinated groups are produced either through the use of fluorine gas or hydrofluoric acid, both of which are very hazardous.

Hess et al. (Surface & Coatings Technology, 195: 121-129 (2005)) and Song et al. (Hydrate Polymers, 92: 928-933 (2013)) produced modified cellulosic articles that have improved hydrophobic properties through the plasma induced deposition of fluorocarbons or acrylate monomers respectively onto cellulose. Using this technique, water contact angles of 100-110° were obtained. However, the production of fluorinated compounds requires the use of many hazardous chemicals and processes. In addition, treatments that require the production of a plasma will entail additional costs.

Hu et al. (Colloids and Surfaces A: Physiochem Eng. Aspects, 351: 65-70 (2009)) produced a cellulosic article with water contact angle exceeding 130°. The technology developed by them requires a 3 component system using precipitated calcium carbonate, stearic acid, and a polymer latex. The latex is composed of a copolymer of styrene and acrylate. The technology does not utilize renewably sourced materials nor is it completely biodegradable. Similarly in a review article by Gaikwad and Ko (Journal of Materials Sciences and Engineering, 4: 1-5 (2015)) the use of clays in providing improved water resistance to paper is described. However, again the necessity for a non-biobased/non-biodegrable latex to bind the clay to the paper is a drawback of these technologies.

Yan et al. (Progress in Paper Coatings, 76: 11-16 (2013)) developed cross-linked cationic latexes that contained epoxy and quaternary ammonium groups that imparted improved water resistance to paper. The commercial purchased latex was combined with a polymer composed of styrene, butyl acrylate, dimethylaminoethyl methacrylate, stearyl methacrylate, and epichlorohydrin. This complicated mixture of materials did not utilize renewably sourced material nor is it completely biodegradable.

Wang et al. ("Preparation and property of waterborne UV-curable chain-extended polyurethane surface sizing agent: Strengthening and waterproofing mechanism for cellulose fiber paper", Journal of Applied Polymer Science, DOI 10.1002/APP.43254) and Zhu et al. ("Properties and paper sizing application of waterborne polyurethanemicroemulsions: Effects of extender, cross-linker, and polyol", Journal of Applied Polymer Science, DOI 10.1002/APP.43211) each developed polyurethane systems that imparted increased water resistance to paper. Each system provided benefits; however, they utilize hazardous isocyanate reagents as well as other hazardous reagents which would entail higher cost. The resulting agents would not utilize renewably sourced materials nor is it completely biodegradable.

Knaup and Gasafi-Martin (WO 2016000831 A1) disclosed the use of fluorinated polyacrylate compositions for use in imparting textiles, preferably cotton or cotton blends, with increased water resistance. The composition was made up of at least three different (meth)acrylic acid esters, one of which is fluorine-containing, and a paraffin wax, and other ingredients such as blocked isocyanates, polysiloxanes, or melamine resins. This complicated mixture would entail high cost, requires the use of hazardous non-biobased chemicals, and would not be biodegradable.

Iselau et al. (Colloids and Surfaces A: Physiochem Eng. Aspects, 483: 264-270 (2015)) utilized nanometer sized organic particles which after deposition on paper provided increased water resistance, as evidenced by having higher contact angles (50-98°) than the control. These particles were produced using a mixture of styrene, t-butyl acrylate, and n-butyl acrylate coupled with a cationic surfactant mixture composed of styrene, dimethylaminopropyl methacrylamide, and 2-dimethylaminoethyl methacrylate. These reagents are hazardous, require complex organic synthesis, and are not biobased nor biodegradable.

Thus there exists a need for environmentally friendly means using biodegradable renewably sourced materials for imparting water resistance to cellulosics such as paper.

Steam jet cooking, as described in Fanta et al., Carbohydrate Polymers, 98: 555-561 (2013), is a rapid and continuous process that is used to prepare aqueous dispersions of starch for commercial applications (Klem, R. E., and D. A. Brogley, Pulp & Paper, 55: 98-103 (1981)). In our labs, our small scale jet cooking equipment uses the excess steam jet cooking technique (Fanta et al., Carbohydrate Polymers, 98: 555-561 (2013)) to produce the complexes. However, the other technique, thermal-jet cooking, can perform a similar function and provide the starch complex. The choice of which type of steam jet cooking to use will generally be dependent on the equipment that each company has. This process has been used commercially for decades to prepare starch solutions for non-food applications such as paper in order to impart wet/dry strength and to alter the surface properties of the paper, such as the absorption of ink. This process involves pumping an aqueous starch slurry through a heating device consisting of specially configured orifice leading to a chamber where the slurry is instantly mixed with steam at high temperature and pressure. The intense turbulence that results from the condensation of high pressure steam and the passage of excess steam through the cooker not only promotes rupture and dissolution of starch granules but also leads to mechanical shearing of starch macromolecules. If the starch being used is high in amylose content (greater than 50%, such as AmyloGel™ 03003, Cargill Inc.), then the structure of the starch will revert back to its original form, a process called retrogradation, and the starch will no longer be soluble. It has been shown that by adding a fatty acid salt or fatty ammonium salt to steam jet cooked amylose starch solution, while still hot, that a water soluble inclusion complex will form (Byars et al., Carbohydrate Polymers, 88: 91-95 (2012); Fanta et al., Carbohydrate Polymers, 98: 555 (2013)). With adjustments in pH, the rheology of the complexes formed from amylose corn starch and the sodium salts of fatty acids will change dramatically (Byars et al., Carbohydrate Polymers, 88: 91-95 (2012)). None of these reports, nor any other publications to date, mention anything about how the high amylose corn starch and fatty ammonium salts (or its amine) interact with cellulosic articles, such as paper or cotton fabrics. We found that when these high amylose corn starch and fatty ammonium salt complexes are applied to cellulosic articles, surprisingly the surface of the article had increased hydrophobicity (as measured using water contact angle, where the water contact angle increases versus a control). After an application of dilute base to convert the ammonium salt of the complex to its free base form, the degree of hydrophobicity surprisingly increases (as measured by increasing contact angle). The described complexes are inherently much safer than other technologies that provide similar properties. In addition, these complexes are produced from renewable materials and are completely biodegradable.

SUMMARY OF THE INVENTION

We have discovered that novel cellulosic (e.g., paper, cotton, cotton blends) articles can be prepared using either amylose fatty-ammonium salt inclusion complexes or amylose fatty-amine inclusion complexes that are easily prepared by converting amylose fatty-ammonium salt inclusion complexes to the water insoluble amine form after incorporation onto the cellulosic article. Both components of the complex are biodegradable. The amylose fatty-ammonium salt inclusion complex is a water soluble material. The application of this complex can be easily performed using standard techniques and equipment. A solution of this complex may be applied to a cellulosic substrate using techniques that are standard in the trade. After drying, the article will have increased water resistance as evidenced by it having an increased water contact angle. If desired, the water resistance can be improved by converting the ammonium group to the free amine by neutralizing with base (e.g., 0.02 Molar sodium hydroxide). After this step, and after drying, the cellulosic article will have increased water resistance as evidenced by an even higher water contact angle than that article treated with the ammonium salt form of the complex. The degree of water resistance may also be controlled through the selection of the fatty amine and the amount of complex added (and other factors).

In accordance with this discovery, it is an object of this invention to provide a method for producing a novel cellulosic article with increased water resistance through the application of an amylose fatty-ammonium salt inclusion complex solution to the cellulosic article.

In accordance with this discovery, it is an object of this invention to provide a method for producing a novel cellulosic article with increased water resistance where the magnitude of the resistance may be adjusted by neutralizing the ammonium salt present in the amylose fatty-ammonium salt inclusion complex to provide the less soluble amylose fatty-amine inclusion complex Other objects and advantages of the invention will become readily apparent from the ensuing description.

This summary is provided to introduce a selection of concepts in a simplified form that are further described below in the detailed description. This summary is not intended to identify key features or essential features of the claimed subject matter, nor is it intended as an aid in determining the scope of the claimed subject matter.

DETAILED DESCRIPTION OF THE INVENTION

Figures 1A, 1B, 1C, 1D:
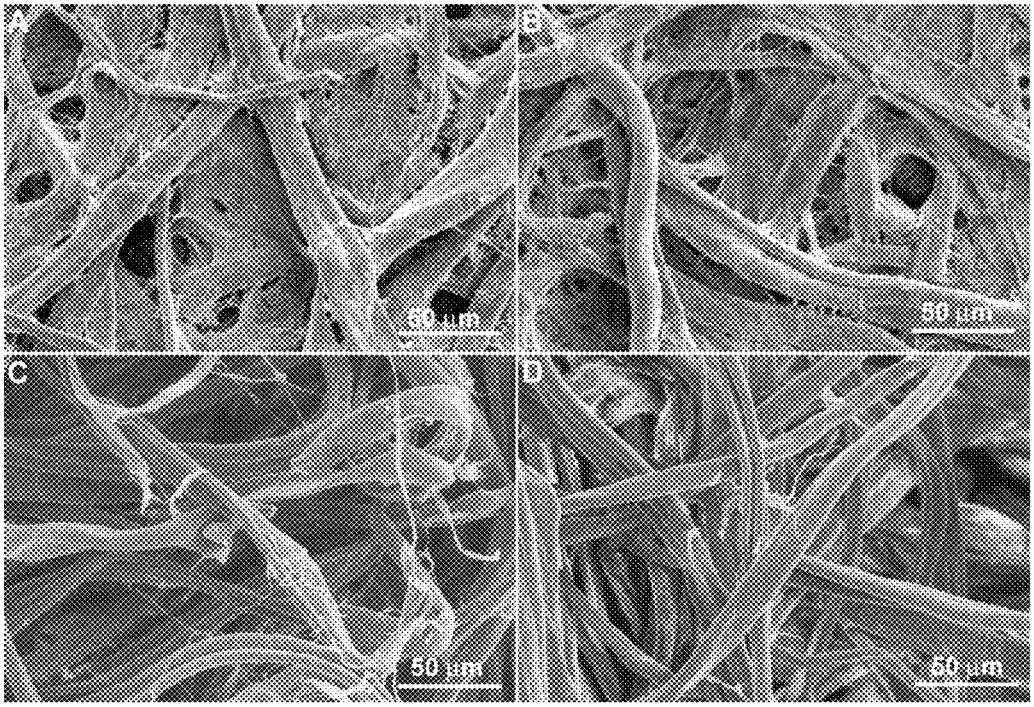
FIGS. 1A, 1B, 1C and 1D show both treated Whatman No. 1 filter paper (FIG. 1A) and untreated Whatman No. 1 filter paper (FIG. 1B), and treated cotton fabric (FIG. 1C) and untreated cotton fabric (FIG. 1D), to determine whether the applied coating of the $C_{16}$ hydrophobic amylose fatty-ammonium salt inclusion complex could be seen on the cellulose fibers of the treated paper or fabric as described below.

We have discovered that novel cellulosic articles (e.g., sheets such as paper sheets, fabrics, yarn, films, fibers; for example made from cotton or cotton blends; See, e.g., Kirk-Othmer, Encyclopedia of Chemical Technology, Third Edition, Vol. 10, J. Wiley & Sons, Inc., 1980 (especially pp. 148, 181)) can be prepared using amylose fatty-ammonium salt inclusion complexes. The amylose containing starch may come from any number of plant sources such as corn or rice. In order to obtain the highest value per pound of starch, high amylose corn starch (containing about 70% amylose), which has more amylose than some other types of starches (e.g., normal dent corn starch containing about 25% amylose), will have higher value for this application. Therefore, high amylose starch was used for the examples detailed below, but its use does not preclude the use of other types of starch having less amylose since these starches may still provide value to cellulosic articles.

The fatty amine that is used for the complex formation (after conversion to the fatty ammonium salt) is derived from natural sources and may have carbon chains from about 10 carbons long through 18 carbons long or mixtures thereof. The fatty amine will be converted to the ammonium salt in water solution through the introduction of an equimolar amount of suitable acid (e.g., hydrochloric acid). The resulting fatty ammonium salt solution will have a pH of approximately 3.5. The amount of fatty ammonium salt which is added to the starch is determined by the amount of amylose present in the starch. The amount of amylose can be determined using standard techniques, and the amount of fatty ammonium salt added will be about 5 to about 10% (e.g., 5 to 10%; preferably about 7.5% (e.g., 7.5%)) of the mass of amylose.

Both components of the complex are biodegradable. The amylose fatty-ammonium salt inclusion complex is a water soluble material. A solution of this complex may be applied to a cellulosic substrate using techniques that are standard in the trade. After drying, the article will have increased water resistance as evidenced by it having an increased water contact angle compared to a control. If desired, the water resistance can be improved by converting the ammonium group to the free amine by neutralizing with base (e.g., 0.02 Molar sodium hydroxide). Other bases and concentrations may be used, and the critical part is that the ammonium salt is converted to the water insoluble free amine complex. After this step, and after drying, the cellulosic article will have increased water resistance as evidenced by an even higher water contact angle than that of an article treated with the amylose fatty-ammonium salt inclusion complex without base treatment.

The concentration of the amylose fatty-ammonium salt inclusion complex in water can be from about 1 to about 5% (e.g., 1 to 5%) solids. The low end of the % solids range will be controlled by two factors. First, determining what degree of water resistance is desired. Second, determining what solution properties of the amylose fatty-ammonium salt inclusion complex solution are acceptable in the commercial environment (i.e., how long will the solution be stored and what are the viscosity limits to name two constraints). The concentration will be dependent on the starch molecular weight and amylose content of the starch. The % solids may be altered for each unique situation encountered in industry to best meet the needs of the process being employed. As the concentration of the amylose fatty-ammonium salt inclusion complex in water is increased, the amount of this complex applied to the paper also increases at the same application rate. Increased water resistance will occur after drying and neutralization with a base (e.g., sodium hydroxide solution, however others bases will also work) as evidenced by increasing water contact angle. Rather than using the concentration of the amylose fatty-ammonium salt inclusion complex in water as a means to apply more complex to a cellulosic article, multiple applications of a lower concentration solution will also give further increases in contact angle.

Since the amylose fraction of the starch is that which forms the complex with the fatty ammonium salt, the magnitude of the increased water resistance imparted to the cellulosic article may also be effected by changing the amount of amylose in the starch. Normal corn starch has about 25% amylose present in it, while high amylose corn starch has about 70% amylose. The amount of fatty ammonium salt that is added to the starch solution will be based on the amylose content, where higher amylose content will result in there being more fatty ammonium salt being added and then more complex being formed. With increased levels of complex, the water resistance will increase when two starch solutions having the same % solids, but increasing in the amylose/complex content, is applied to a cellulosic article at the same application rate. Through selection of the starch source, varying levels of water resistance may be imparted to the cellulosic article.

Amylose fatty-ammonium salt inclusion complexes (e.g., from dodecylamine ($C_{12}$), hexadecylamine ($C_{16}$), and octadecylamine ($C_{18}$)) are generally prepared as follows: Steam jet cooking of starch is generally described in Pulp & Paper, 55: 98-103 (1981) and by Byars et al., Carbohydrate Polymers, 88: 91-95 (2012). High amylose corn starch (such as AmyloGel™ 03003, Cargill, Minneapolis, Minn., amylose content about 70%) in water is passed through a steam jet cooker (e.g., Penick and Ford laboratory model) operating under excess steam conditions (as described in Fanta et al., Carbohydrate Polymers, 98: 555-561 (2013)). The temperature in the hydroheater is about 140° C. (e.g., 140° C.; temperature may range between about 135° to about 145° C. (e.g., 135° to 145° C.)), the steam back pressure is about 380 kPa or about 40 psig (e.g., 380 kPa or 40 psig; pressure will be set by the temperature of the hydroheater), and the steam line pressure from the boiler is about 550 kPa or about 65 psig (e.g., 550 kPa or 65 psig; generally about 60 to about 70 psig (e.g., 60 to 70 psig)). For a self-explanatory diagram of this process, see FIG. 2 of Klem, R. E., and D. A. Brogley, Pulp & Paper, 55: 98-103 (1981). The hot, jet cooked solution of starch was collected in a container, and after all of the starch dispersion was passed through the cooker a minimum amount of water (e.g. about 50 to about 100 mL) is passed through the cooker to maximize the recovery of dissolve starch.

Solutions of the HCl salts of fatty amines (having carbon chains from 10 carbons long through 18 carbons long) are prepared separately by dispersing the fatty amine used to form the amylose fatty ammonium salt inclusion complex in water solution with an HCl concentration equal to that required to convert the amine to its ammonium salt. The acidified amine dispersions are then heated to about 90° C. (e.g., 90° C.) to obtain clear solutions. The hot solutions of fatty ammonium salts are then added to the hot starch dispersions, and the dispersions are slowly stirred and then cooled to about 25° C. (e.g., 25° C.). The amylose fatty-ammonium salt inclusion complexes are then isolated by freeze drying, although spray drying is a more economical drying process and may also be used, and the moisture contents of the complexes are calculated from the loss in weight after heating for about 4 hours (e.g., 4 hours) under vacuum over phosphorous pentoxide ($P_2O_5$).

The application of the amylose fatty-ammonium salt inclusion complexes can be easily performed using standard techniques and equipment. A solution of this complex may be applied to a cellulosic substrate using techniques that are standard in the trade. After drying, the article will have increased water resistance as evidenced by it having an increased water contact angle. If desired, the water resistance can be improved by converting the ammonium group to the free amine by neutralizing with base (e.g., 0.02 Molar sodium hydroxide).

Other compounds may be added to the complex provided they do not substantially interfere with the intended activity and efficacy of the complex; whether or not a compound interferes with activity and/or efficacy can be determined, for example, by the procedures utilized herein.

The amounts, percentages and ranges disclosed herein are not meant to be limiting, and increments between the recited amounts, percentages and ranges are specifically envisioned as part of the invention.

"Optional" or "optionally" means that the subsequently described event or circumstance may or may not occur, and that the description includes instances in which said event or circumstance occurs and instances where it does not. For example, the phrase "optionally comprising a defoaming agent" means that the composition may or may not contain a defoaming agent and that this description includes compositions that contain and do not contain a foaming agent.

By the term "effective amount" of a compound or property as provided herein is meant such amount as is capable of performing the function of the compound or property for which an effective amount is expressed. As will be pointed out below, the exact amount required will vary from process to process, depending on recognized variables such as the compounds employed and the processing conditions observed. Thus, it is not possible to specify an exact "effective amount." However, an appropriate effective amount may be determined by one of ordinary skill in the art using only routine experimentation.

Unless defined otherwise, all technical and scientific terms used herein have the same meaning as commonly understood by one of ordinary skill in the art to which the invention belongs. As used herein, the term "about" refers to a quantity, level, value or amount that varies by as much as 30%, preferably by as much as 20%, and more preferably by as much as 10% to a reference quantity, level, value or amount. Although any methods and materials similar or equivalent to those described herein can be used in the practice or testing of the present invention, the preferred methods and materials are now described.

The following examples are intended only to further illustrate the invention and are not intended to limit the scope of the invention as defined by the claims.

EXAMPLES

Example 1

Preparation of Amylose Fatty Ammonium Salt Inclusion Complexes. Preparation of amylose fatty-ammonium salt inclusion complexes from dodecylamine ($C_{12}$), hexadecylamine ($C_{16}$), and octadecylamine ($C_{18}$): Steam jet cooking of starch is generally described in Pulp & Paper, 55: 98-103 (1981) and by Byars et al., Carbohydrate Polymers, 88: 91-95 (2012). We passed a dispersion of 50.0 g of high amylose corn starch (such as AmyloGel™ 03003, Cargill, Minneapolis, Minn., amylose content about 70%) in 900 mL of water through a Penick and Ford laboratory model steam jet cooker operating under excess steam conditions (as described in Fanta et al., Carbohydrate Polymers, 98: 555-561 (2013)). The temperature in the hydroheater was about 140° C. (e.g., 140° C.; temperature may range between about 135° to about 145° C. (e.g., 135° to 145° C.)), the steam back pressure was about 380 kPa or about 40 psig (e.g., 380 kPa or 40 psig; pressure will be set by the temperature of the hydroheater), and the steam line pressure from the boiler was about 550 kPa or about 65 psig (e.g., 550 kPa or 65 psig; generally about 60 to about 70 psig (e.g., 60 to 70 psig)). Pumping rate of the water dispersion of starch through the jet-cooker was about 1.0±0.1 L/min (e.g., 1.0±0.1 L/min). The hot, jet cooked solution of starch was collected in a stainless steel Waring blending container, and after all of the starch dispersion was passed through the cooker, water was passed through the cooker for 10-15 seconds to maximize the recovery of dissolve starch.

Solutions of the HCl salts of fatty amines (having carbon chains from 10 carbons long through 18 carbons long) were prepared separately by dispersing 2.6 g of the fatty amine used to form the amylose fatty ammonium salt inclusion complex in 100 to 150 ml of water solution with an HCl concentration equal to that required to convert the amine to its ammonium salt. This weight of fatty amine was equal to 7.5% of the weight of amylose in the 50.0 g of high amylose corn starch used. The acidified amine dispersions were then heated to 90° C. to obtain clear solutions.

The hot solutions of fatty ammonium salts were then added to the hot starch dispersions, and the dispersions were slowly stirred for 1 min. and then cooled to 25° C. The amylose fatty-ammonium salt inclusion complexes were then isolated by freeze drying, although spray drying is a more economical drying process and may also be used, and the moisture contents of the complexes were calculated from the loss in weight after heating for 4 hours under vacuum over phosphorous pentoxide ($P_2O_5$).

Example 2

Preparation of Paper Coated with 3.5% Amylose-Dodecylammonium, Hexadecylammonium or Octadecylammonium salt Inclusion Complexes and application of the amylose fatty-ammonium salt inclusion complexes (prepared in Example 1) to paper to enhance water resistance and inhibit the penetration of water: Water solutions of freeze dried amylose-$C_{12}$, $C_{16}$, and $C_{18}$ ammonium salt inclusion complexes at concentrations of 3.5% were prepared by heating water dispersions of the respective freeze dried amylose fatty-ammonium salt inclusion complex to 80° C. and then cooling the solutions to 25° C. Solutions of the amylose fatty-ammonium salt inclusion complexes were applied to circles of Whatman No. 1 filter paper in a Buchner filter funnel. The amount of amylose fatty-ammonium salt inclusion complex solution applied was just enough to thoroughly wet the filter paper without a large excess of applied solution. Vacuum was then applied to the filter funnel to remove the small excess of amylose fatty-ammonium salt inclusion complex solution and the wet filter papers were allowed to air dry. The air dried filter papers were placed back into the Buchner filter funnel and just enough 0.02 Molar sodium hydroxide solution was applied to wet the filter paper without a large excess of applied solution. Vacuum was then applied to the filter funnel to remove the small excess of sodium hydroxide solution. The wet filter papers were given one water wash by applying just enough water to cover the surface of the filter paper and then applying vacuum to remove excess water. The wet filter papers were then allowed to air dry and then their water contact angles were measured. Surface contact angle measurements were conducted on treated papers using axisymmetric dropshape analysis on a FTA-200 automated goniometer with fta32 v2.0 software. Contact angles were determined by analyzing the shape of a drop of water when placed on the surface of a treated paper (Fanta et al., Starch—Stärke, DOI 10.1002/star.201500242 (2016). Measurements were conducted at 23±2° C. The instrument comprises an automated pump that delivers a drop of water to the film surface, after which images are captured for further analysis. The software allows for automated measurement using the captured images. After the water drop was applied to the surface, 120 images were taken at a series of time intervals, where the time elapsed before a subsequent image was taken was determined by the following equation: $time=0.06491\times e^{(0.0315\times image\#)}$. Initial contact angles were obtained using the first image that had well defined edges that were no longer vibrating due to drop application. Results are shown in Table 1. As it can be seen, for the control paper the initial contact angle was very low at 14° and the water drop soaked into the paper in less than 1 second. When the $C_{12}$, $C_{16}$ or $C_{18}$ amylose-ammonium salt inclusion complexes were applied to the paper and treated with sodium hydroxide solution, it can be seen that the contact angle was surprisingly much higher than the control and that the water soaked into the paper after a much longer time. The value that these results demonstrate are obvious, where value may be captured in food packaging, printing, or shipping containers.

Example 3

Preparation of Paper Coated with various concentrations of Amylose-Hexadecylammonium salt Inclusion Complexes and application of a lower concentration of the amylose-$C_{16}$ ammonium salt inclusion complexes to paper to determine the effect of lower concentration of the complex on water resistance and penetration of water: Water solutions of the freeze dried $C_{16}$ amylose-ammonium salt inclusion complex at concentrations of 0.5, 0.9, 1.8, 2.7, and 3.1% were prepared by heating water dispersions to 80° C. and then cooling the solutions to 25° C. The solutions of amylose fatty-ammonium salt inclusion complex were applied to Whatman No. 54 filter paper in a Buchner filter funnel as detailed earlier. The papers were allowed to air-dry. The dried papers were then treated with 0.02 N sodium hydroxide solution, rinsed with a small amount of water, and were allowed to air dry, then their water contact angles were measured. Surface contact angle measurements were conducted on treated papers using axisymmetric dropshape analysis on a Kruss-DSA24 Drop Shape Analyzer using the supplied software. Initial contact angles were obtained using the first image that had well defined edges that were no longer vibrating due to drop application. Results are shown in Table 2. Table 2 displays the data describing the relationship between the concentration of $C_{16}$ amylose-ammonium salt inclusion complex which was applied to the paper and the resulting contact angle. As it can be seen, for the control paper the initial contact angle was very low at 14° and the water drop soaked into the paper in 0.2 second. When the complex was applied at the lowest concentration of 0.5% solids, the initial contact angle was surprisingly much higher than the control (54° vs 14°) and the water soaked into the paper at a longer period of time (0.75 seconds). As the concentration of the complex in solution was increased, it can be seen that the initial water contact angle increased and the time for water to soak into the paper also increased. This demonstrated through the use of solution at various concentration that various degrees of increased surface hydrophobicity can be obtained. This allows for higher value in different end-uses/markets.

Example 4

Preparation of Paper Coated with 1.8 and 3.1% Amylose-Hexadecylammonium salt Inclusion Complexes with No Additional Base Treatment: Determination of the impact of eliminating the base treatment on the water resistant properties imparted by the paper coatings. Water solutions of the freeze dried $C_{16}$ amylose-ammonium salt inclusion complex at a concentrations of 1.8, and 3.1% were prepared by heating water dispersions to 80° C. and then cooling the solutions to 25° C. The solutions of amylose fatty-ammonium salt inclusion complexes were applied to Whatman No. 54 filter paper in a Buchner filter funnel as detailed earlier. The papers were allowed to air-dry. Surface contact angle measurements were conducted on the treated papers using axisymmetric dropshape analysis on a Kruss-DSA24 Drop Shape Analyzer using the supplied software as detailed in Example 3. Initial contact angles were obtained using the first image that had well defined edges that were no longer vibrating due to drop application. Shown in Table 3 are the results demonstrating the impact on contact angle when base is not applied to the paper. As it can be seen, for the control paper the initial contact angle was very low at 14° and the water drop soaked into the paper in 0.2 second. When solutions of either 1.8% or 3.1% of the complex were applied to the paper, the contact angles were surprisingly much higher than the control although the contact angles measured were not as high as those paper samples treated with base (see Examples 2 and 3). This demonstrated that the application of base is not required for increased surface hydrophobicity of cellulosic articles versus the control.

Example 5

Preparation of hydroentangled Cotton Fabric Coated with 2 and 3.5% Amylose Hexadecylammonium salt Inclusion Complexes to enhance water resistance and inhibit the penetration of water: Water solutions of the freeze dried $C_{16}$ amylose-ammonium salt inclusion complex at a concentration of 2 and 3.5% were prepared by heating water dispersions to 80° C. and then cooling the solutions to 25° C. The cotton fabric used was hydroentangled and was not sized. Circles of 11 cm were cut from the fabric and placed in a Buchner filter funnel. The solutions of amylose fatty-ammonium salt inclusion complex were then applied to the cotton fabric as described Example 2 and the circles of fabric were allowed to air-dry. The treated cotton fabrics were then treated with 0.02 N sodium hydroxide solution, rinsed with a small amount of water, subjected to vacuum to remove excess water, and were allowed to air dry. To get complete drying, the fabric circles were dried in a forced air oven at 23° C. Surface contact angle measurements were conducted on the treated fabrics using axisymmetric dropshape analysis on a FTA-200 automated goniometer with fta32 v2.0 software in fashion as detailed in Example 2. Initial contact angles were obtained using the first image that had well defined edges that were no longer vibrating due to drop application. Results are shown in Table 4. As it can be seen, for the control cotton fabric the initial contact angle was at 124° and the water drop soaked into the paper in 0.1 second. When solutions of either 2.0% or 3.5% of the complex were applied to the cotton fabric, the contact angle was surprisingly much higher than the control and the water drop did not soak into the fabric during the test period. This demonstrated that the complexes are capable of modifying the surface properties of cotton fabrics.

Example 6

Scanning electron microscopy (SEM) was used to examine both treated and untreated Whatman No. 1 filter paper, and treated and untreated unsized cotton fabric, to determine whether the applied coating of hydrophobic $C_{16}$ amylose-ammonium salt inclusion complex could be seen on the cellulose fibers of the treated paper and cotton fabric. Comparison of the SEM images of the treated and un-treated papers and fabrics (FIG. 1) showed no detectable differences, indicating that the amount of amylose complex responsible for the dramatic increase in water resistance was too small to be seen, even by high-magnification electron microscopy. The composite figure, shown below, includes representative images of (A) uncoated paper, (B) coated paper, (C) uncoated cotton fabric, and (D) coated cotton fabric samples. This observation was quite surprising because the tendency of starches in general to gel, precipitate, or aggregate in some manner would seem to make it more likely that some structurally obvious deposition of starch on the fibers would be seen. Without being bound by theory, this lack of visible accretion of material on or around the fibers suggests that the complexes were very uniformly distributed on the surface of each fiber as opposed to coarsely precipitated onto the fiber matrix. It was surprising that the treatment imposed on the paper and fabric had such a profound effect on the hydrophobicity without obscuring the fibrous structure with a visible coating layer or otherwise filling the gaps between the fibers.

We have thus demonstrated that high value cellulosic articles having increased surface hydrophobicity, as determined by water contact angle measurements, can surprisingly be easily and economically prepared by applying water solutions of amylose fatty-ammonium salt inclusion complexes. These complexes are prepared using the inexpensive and widely used commercial process of steam jet cooking. The starch used must contain amylose, and high amylose varieties of corn starch are preferred because they are readily available commercially. Hot solutions of steam jet cooked starch are then combined with hot solutions of fatty ammonium salts, with carbon chains varying from $C_8$ to $C_{18}$, in water solution. The amylose fatty-ammonium salt inclusion complexes may be isolated using standard methods of drying, such as freeze drying or spray drying. Dried samples of the amylose fatty-ammonium salt inclusion complexes may be easily dissolved in water by heating to 80° C., and the resulting solutions may then be applied to cellulosic articles, such as paper or cotton fabrics, to surprisingly impart increased surface hydrophobicity. Surface hydrophobicities may be easily increased by applying an alkaline water solution, such as dilute sodium hydroxide, to the treated paper or cotton fabric. The application of a dilute alkaline solution converts the applied amylose fatty-ammonium salt inclusion complexes to amylose fatty-amine inclusion complexes which are water insoluble.

All of the references cited herein, including U.S. patents and U.S. patent application Publications, are incorporated by reference in their entirety.

Thus, in view of the above, there is described (in part) the following:

A method of increasing the surface hydrophobicity of the surface of a cellulosic article (compared to the surface hydrophobicity of untreated control samples), said method comprises (or consists essentially of or consists of) applying a solution of amylose fatty-ammonium salt inclusion complex in water to said article and then optionally applying an alkaline solution to said article to neutralize said amylose fatty ammonium salt inclusion complex to form an insoluble amylose fatty amine inclusion complex. The method, wherein the concentration of said amylose fatty-ammonium salt inclusion complex in water is from about 1 to about 5% solids. The method, wherein said amylose-fatty ammonium salt inclusion complex is made by a process comprising passing amylose and water through a steam jet cooker at a temperature of about 140° C. and a pressure of about 550 kPa to form a jet cooked starch solution and adding water solutions of fatty ammonium salts (having a carbon chains sufficiently long to form stable inclusion complexes; for example C10 to C10) to said jet cooked starch solutions to form said amylose-fatty ammonium salt inclusion complexes.

A cellulosic article, said cellulosic article made by the above method. The cellulosic article, wherein said cellulosic article has a contact angle at least about 5 degrees up to about 150 degrees (e.g., 5 to 150 degrees) higher than a control cellulosic article (not prepared by the above method). The cellulosic article, wherein said cellulosic article is paper or a cellulosic paper product that has a contact angle at least about 5 degrees up to about 150 degrees higher than a control cellulosic paper or a cellulosic paper product. The cellulosic article, wherein said cellulosic article is a cotton fiber, fabric or yarn, that has a contact angle at least about 5 degrees up to about 150 degrees higher than a control cotton fiber, fabric or yarn.

The term "consisting essentially of" excludes additional method steps or composition components that substantially interfere with the intended activity of the method or composition, and can be readily determined by those skilled in the art (for example, from a consideration of this specification or practice of the invention disclosed herein). The invention illustratively disclosed herein suitably may be practiced in the absence of any element which is not specifically disclosed herein.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

TABLE 1

| Treatment | Contact angle after # seconds 0 | 30 | 60 |
|---|---|---|---|
| Control | 14* | — | — |
| C12 | 58 | 6 | ** |
| C16 | 89 | 91 | 91 |
| C18 | 89 | 48 | 30 |

*water drop absorbed into paper at 0.6 seconds

**water drop absorbs into paper at 28 seconds

TABLE 2

| % Starch Hexadecylammonium complex solution | Contact angle after # seconds 0 | 30 | 60 |
|---|---|---|---|
| 0 (control) | 14* | — | — |
| 0.5 | 54** | — | — |
| 0.9 | 90 | — | — |
| 1.8 | 105 | 86 | 79 |
| 2.7 | 117 | 81 | 72 |
| 3.1 | 126 | 109 | 103 |

*water drop absorbed into paper at 0.2 seconds

**water drop absorbs into paper at 0.75 seconds

TABLE 3

| % Starch Hexadecylammonium complex solution | Contact angle after # seconds 0 | 30 | 60 |
|---|---|---|---|
| 0 (control) | 14* | — | — |
| 1.8 | 61** | — | — |
| 3.1 | 91 | 73 | 68 |

*water drop absorbed into paper at 0.2 seconds

**water drop absorbs into paper at 16.7 seconds

TABLE 4

| % Starch Hexadecylammonium complex solution | Contact angle after # seconds 0 | 30 | 60 |
|---|---|---|---|
| 0 (control) | 124* | — | — |
| 2.0 | 141 | 131 | 125 |
| 3.5 | 145 | 139 | 136 |

*water drop absorbed into paper at 0.1 seconds

We claim:

1. A method of increasing the surface hydrophobicity of the surface of a cellulosic article, said method comprises applying a solution of amylose-fatty ammonium salt inclusion complex in water to the surface of said article and then optionally applying an alkaline solution to the surface of said article.

2. The method according to claim 1, wherein the concentration of said amylose-fatty ammonium salt inclusion complex in water is from about 1 to about 5% solids.

3. The method according to claim 1, wherein said amylose-fatty ammonium salt inclusion complex is made by a process comprising passing amylose and water through a steam jet cooker at a temperature of about 140° C. and a pressure of about 550 kPa to form a jet cooked starch solution and adding water solutions of fatty ammonium salts to said jet cooked starch solutions to form said amylose-fatty ammonium salt inclusion complexes.

4. A cellulosic article, said cellulosic article made by the method according to claim 1.

5. The cellulosic article according to claim 4, wherein said cellulosic article has a contact angle at least about 5 degrees up to about 150 degrees higher than a control cellulosic article.

6. The cellulosic article according to claim 5, wherein said cellulosic article is paper or a cellulosic paper product that has a contact angle at least about 5 degrees up to about 150 degrees higher than a control cellulosic paper or a cellulosic paper product.

7. The cellulosic article according to claim 5, wherein said cellulosic article is a cotton fiber, fabric or yarn, that has a contact angle at least about 5 degrees up to about 150 degrees higher than a control cotton fiber, fabric or yarn.

8. The method according to claim 1, wherein said method comprises applying a solution of amylose-fatty ammonium salt inclusion complex in water to the surface of said article and then applying an alkaline solution to the surface of said article.

* * * * *